US010274213B2

(12) United States Patent
Henderson et al.

(10) Patent No.: US 10,274,213 B2
(45) Date of Patent: Apr. 30, 2019

(54) AIR CONDITIONING SYSTEM INCLUDING A HYBRID REHEAT LOOP

(71) Applicant: Haier US Appliance Solutions, Inc., Wilmington, DE (US)

(72) Inventors: Richard Dustin Henderson, La Grange, KY (US); Thomas James Stutts, Louisville, KY (US); Robert T. Mills, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/582,850

(22) Filed: May 1, 2017

(65) Prior Publication Data

US 2018/0313554 A1 Nov. 1, 2018

(51) Int. Cl.

| | |
|---|---|
| ***F24F 11/30*** | (2018.01) |
| ***F24F 11/65*** | (2018.01) |
| ***F24F 11/83*** | (2018.01) |
| ***F24F 11/84*** | (2018.01) |
| ***F24F 3/153*** | (2006.01) |
| ***F24F 3/14*** | (2006.01) |
| *F24F 11/85* | (2018.01) |
| *F24F 110/10* | (2018.01) |
| *F24F 110/20* | (2018.01) |

(52) U.S. Cl.

CPC ..... *F24F 3/153* (2013.01); *F24F 3/1405* (2013.01); *F24F 11/30* (2018.01); *F24F 11/65* (2018.01); *F24F 11/83* (2018.01); *F24F 11/84* (2018.01); *F24F 11/85* (2018.01); *F24F 2110/10* (2018.01); *F24F 2110/20* (2018.01)

(58) Field of Classification Search

CPC ..... F24F 3/153; F24F 2110/20; F24F 11/30; F24F 2110/10; F24F 11/83; F24F 3/1405; F24F 11/85; F24F 11/84

USPC ..... 62/176

See application file for complete search history.

(56) References Cited

U.S. PATENT DOCUMENTS 5,345,776 A * 9/1994 Komazaki ..... F24F 3/14 62/176.3
6,012,296 A * 1/2000 Shah ..... F24F 11/0008 62/173

(Continued)

FOREIGN PATENT DOCUMENTS

CN 1232772 C 12/2005
CN 101149168 B 5/2010

(Continued)

*Primary Examiner* — Henry T Crenshaw
(74) *Attorney, Agent, or Firm* — Dority & Manning, P.A.

(57) ABSTRACT

An air conditioning system and a method of operating the same are provided. The air conditioning system includes a refrigeration loop having a variable speed compressor for circulating a refrigerant through an outdoor heat exchanger, a first expansion device, a hybrid heat exchanger, a second expansion device, and an indoor heat exchanger. The air conditioning system is operated in one of four modes depending on the indoor temperature and humidity relative to target values. The modes include an air conditioning mode, a dehumidification mode, an idle mode, and a reheat mode in which the first expansion device is fully opened and the second expansion device throttles the refrigerant to achieve a target temperature difference across the hybrid heat exchanger.

18 Claims, 2 Drawing Sheets

(56) References Cited

U.S. PATENT DOCUMENTS

| | | | | |
|---|---|---|---|---|
| 6,904,767 | B1 * | 6/2005 | Wright | F24F 3/153 62/427 |
| 7,165,414 | B2 | 1/2007 | Wright | |
| 7,845,185 | B2 | 12/2010 | Knight et al. | |
| 2006/0100744 | A1 * | 5/2006 | Sharma | F24F 11/0008 700/276 |
| 2010/0242508 | A1 * | 9/2010 | Lifson | F24F 3/1405 62/115 |
| 2011/0100035 | A1 * | 5/2011 | Taras | F24F 3/153 62/90 |
| 2011/0113800 | A1 * | 5/2011 | Sekiya | B60H 1/00278 62/151 |
| 2012/0037352 | A1 * | 2/2012 | Osaka | B60H 1/00021 165/202 |
| 2012/0272669 | A1 * | 11/2012 | Blanton | F25B 5/02 62/89 |
| 2013/0283831 | A1 * | 10/2013 | Hua | F25B 41/04 62/115 |
| 2013/0306290 | A1 * | 11/2013 | MacKelvie | F28F 1/00 165/181 |
| 2014/0026600 | A1 * | 1/2014 | Wippler | B60H 1/00785 62/80 |
| 2014/0290288 | A1 * | 10/2014 | Burns | F25B 49/02 62/115 |

FOREIGN PATENT DOCUMENTS

| | | | |
|---|---|---|---|
| JP | 2003106706 | A | 4/2003 |
| JP | 2004012111 | A | 1/2004 |
| JP | 2005201489 | A | 7/2005 |
| JP | 4389430 | B2 | 12/2009 |

* cited by examiner

AIR CONDITIONING SYSTEM INCLUDING A HYBRID REHEAT LOOP

FIELD OF THE INVENTION

The present disclosure relates generally to air conditioning systems, and more particularly to air conditioners having hybrid reheat loops.

BACKGROUND OF THE INVENTION

Air conditioning systems are conventionally utilized to condition air within an indoor space—i.e., to adjust the temperature and humidity of the air within structures such as dwellings and office buildings. Such systems commonly include a closed refrigeration loop to condition the indoor air which is recirculated while being heated or cooled. Certain refrigeration loops include an outdoor heat exchanger positioned outdoors, an indoor heat exchanger positioned indoors, and tubing or conduit for circulating a flow of refrigerant through the heat exchangers to facilitate heat transfer.

When the air within the indoor space is humid, it may be desirable to remove moisture from the air. Air conditioning systems typically dehumidify air by passing the humid air over an indoor heat exchanger that has cool refrigerant passing through its coils. As the humid air passes through the indoor heat exchanger and crosses over its refrigerant cooled coils, the coils pull moisture from the air by lowering the temperature of the air and causing moisture in the air to condense on the coils. The dehumidified air is then passed into the indoor space at a lower temperature and humidity.

However, in certain situations, such as when it is cool and humid outside, such a dehumidification process may lower the temperature of indoor air below the target temperature of the indoor space. Certain air conditioning systems use electric heaters to heat the indoor air downstream of the indoor heat exchanger. However, such electric heaters are costly and decrease the energy efficiency of the air conditioning system.

Accordingly, improved air conditioning systems with features for removing humidity from indoor air without cooling the air below the target indoor temperature would be useful.

BRIEF DESCRIPTION OF THE INVENTION

The present subject matter provides an air conditioning system and a method of operating the same. The air conditioning system includes a refrigeration loop having a variable speed compressor for circulating a refrigerant through an outdoor heat exchanger, a first expansion device, a hybrid heat exchanger, a second expansion device, and an indoor heat exchanger. The air conditioning system is operated in one of four modes depending on the indoor temperature and humidity relative to target values. The modes include an air conditioning mode, a dehumidification mode, an idle mode, and a reheat mode in which the first expansion device is fully opened and the second expansion device throttles the refrigerant to achieve a target temperature difference across the hybrid heat exchanger. Additional aspects and advantages of the invention will be set forth in part in the following description, may be obvious from the description, or may be learned through practice of the invention.

In accordance with one embodiment, an air conditioning system is provided including a refrigeration loop including an outdoor heat exchanger, a hybrid heat exchanger, and an indoor heat exchanger in serial flow communication with each other. A variable speed compressor is operably coupled to the refrigeration loop and is configured for circulating refrigerant through the refrigerant loop. A first expansion device is operably coupled to the refrigeration loop between the outdoor heat exchanger and the hybrid heat exchanger and a second expansion device is operably coupled to the refrigeration loop between the hybrid heat exchanger and the indoor heat exchanger. A controller is configured for obtaining an indoor temperature using an indoor temperature sensor and an indoor humidity using an indoor humidity sensor. The controller is further configured for operating the air conditioning system in an air conditioning mode if the indoor temperature is greater than a target temperature and operating the air conditioning system in a reheat mode if the indoor temperature is below the target temperature and the indoor humidity is greater than a target humidity.

In accordance with another embodiment, a method of operating an air conditioning system is provided. The air conditioning system includes a refrigeration loop having a variable speed compressor for circulating a refrigerant through an outdoor heat exchanger, a first expansion device, a hybrid heat exchanger, a second expansion device, and an indoor heat exchanger. The method includes obtaining an indoor temperature using an indoor temperature sensor and an indoor humidity using an indoor humidity sensor. The method further includes operating the air conditioning system in an air conditioning mode if the indoor temperature is greater than a target temperature and operating the air conditioning system in a reheat mode if the indoor temperature is below the target temperature and the indoor humidity is greater than a target humidity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
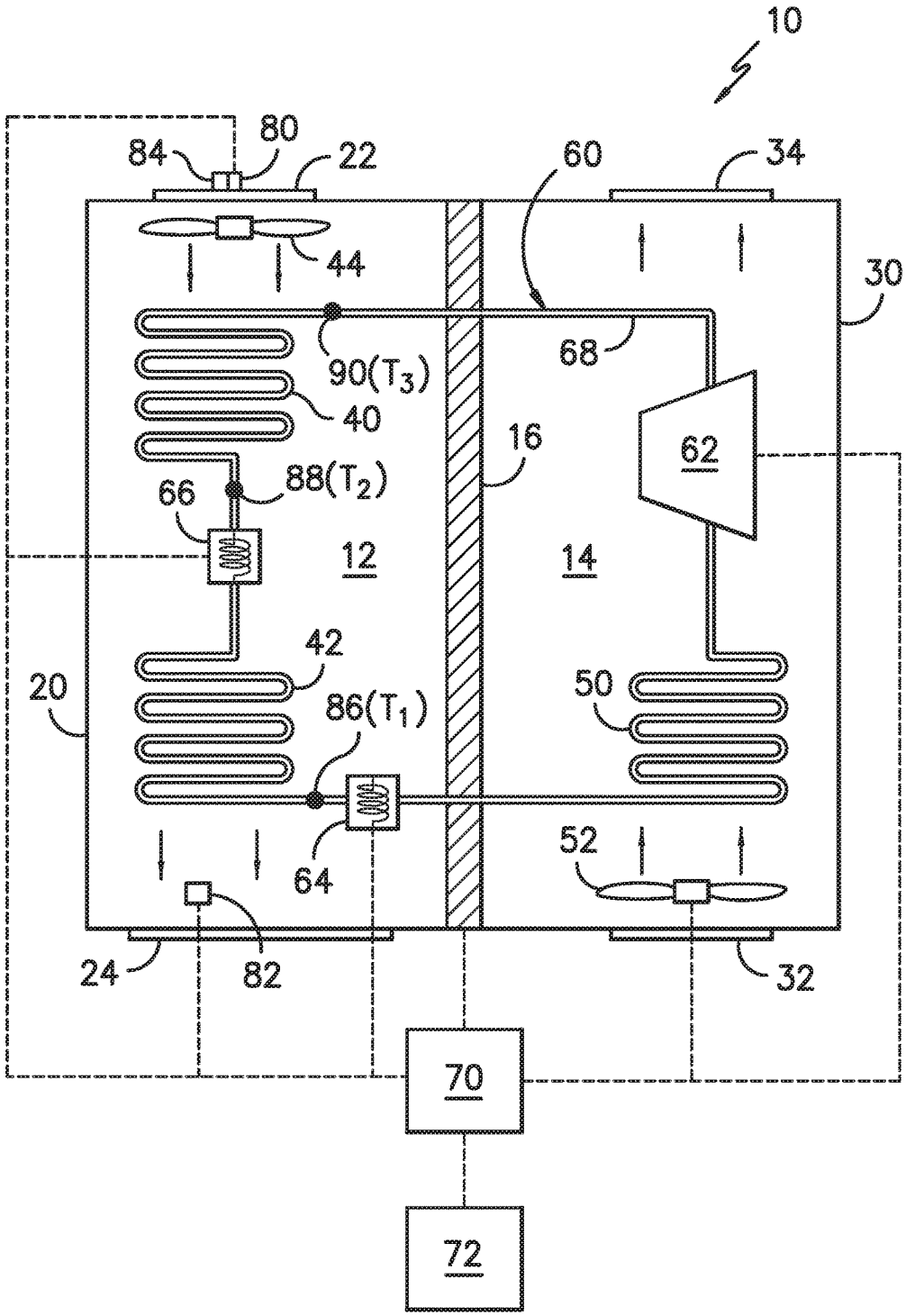
FIG. 1 provides a schematic view of an air conditioning system in accordance with one exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, an air conditioning system 10 is provided. The system 10 includes an indoor portion 12 and an outdoor portion 14 separated by a partition 16, such as a wall. Although indoor portion 12 and outdoor portion 14 are illustrated as being adjacent to each other and separated by partition 16, it should be appreciated that this is only one exemplary embodiment. According to alternative embodiments, indoor portion 12 and outdoor portion 14 may be positioned separate from each other and connected by extended lengths of tubing or conduit.

Indoor portion 12 of air conditioning system 10 may generally define an indoor air duct 20 through which indoor air may be circulated for conditioning. More specifically, indoor air duct 20 may define an indoor return vent 22 for drawing a flow of indoor air into system 10 and an indoor supply vent 24 positioned downstream of indoor return vent 22 for supplying conditioned indoor air back into the room. It should be appreciated that the terms "upstream" and "downstream" refer to the relative direction with respect to fluid flow in a fluid pathway. For example, "upstream" refers to the direction from which the fluid flows, and "downstream" refers to the direction to which the fluid flows.

Similarly, outdoor portion 14 of air conditioning system 10 may generally define an outdoor air duct 30 through which outdoor air may be passed, e.g., for discharging thermal energy to the ambient environment. More specifically, outdoor air duct 30 may define an inlet 32 for drawing a flow of ambient air into system 10 and an outlet 34 positioned downstream of inlet 32 for discharging outdoor air from system 10.

Air conditioning system 10 includes a primary indoor heat exchanger 40 and a hybrid heat exchanger 42 which are positioned within indoor duct 20 between indoor return vent 22 and indoor supply vent 24. In addition, an indoor fan 44 is in fluid communication with indoor duct 20 for urging a flow of air through indoor heat exchanger 40 and hybrid heat exchanger 42. In addition, air conditioning system 10 includes an outdoor heat exchanger 50 which is positioned within outdoor duct 30 between inlet 32 and outlet 34. An outdoor fan 52 is in fluid communication with outdoor duct 30 for urging a flow of air through outdoor heat exchanger 50.

Heat exchangers 40, 42, and 50 may be components of a refrigeration loop 60, which is shown schematically in FIG. 1. Refrigeration loop 60 may, for example, further include a compressor 62, a first expansion device 64, and a second expansion device 66. As illustrated, compressor 62, first expansion device 64, and second expansion device 66 may be in fluid communication with indoor heat exchanger 40, hybrid heat exchanger 42, and outdoor heat exchanger 50 to flow refrigerant therethrough as is generally understood. More particularly, refrigeration loop 60 may include various lines or conduit 68 for flowing refrigerant between the various components of refrigeration loop 60, thus providing the fluid communication there between.

According to the illustrated embodiment, compressor 62 is in direct fluid communication with the outdoor heat exchanger 50. In this manner, compressor 62 and outdoor heat exchanger 50 are directly connected through a piece of conduit 68 such that no devices or components are positioned between them. In addition, hybrid heat exchanger 42 is positioned on refrigeration loop 60 downstream of outdoor heat exchanger 50. As illustrated, first expansion device 64 is positioned between outdoor heat exchanger 50 and hybrid heat exchanger 42 and second expansion device 66 is positioned between hybrid heat exchanger 42 and indoor heat exchanger 40. In this manner, refrigerant flows through the connecting conduit 68 from compressor 62 to outdoor heat exchanger 50, from outdoor heat exchanger 50 through first expansion device 64 to hybrid heat exchanger 42, from hybrid heat exchanger 42 through second expansion device 66 to indoor heat exchanger 40, and from indoor heat exchanger 40 back into compressor 62. The refrigerant may generally undergo phase changes associated with a refrigeration cycle as it flows to and through these various components, as is generally understood. Suitable refrigerants for use in refrigeration loop 60 may include pentafluoroethane, difluoromethane, or a mixture such as R410a, although it should be understood that the present disclosure is not limited to such example and rather that any suitable refrigerant may be utilized.

As is understood in the art, refrigeration loop 60 may be alternately be operated as a refrigeration assembly (and thus perform a refrigeration cycle) or a heat pump (and thus perform a heat pump cycle). When refrigeration loop 60 is operating in a cooling mode and thus performs a refrigeration cycle, the indoor heat exchanger 40 and/or hybrid heat exchanger 42 act as an evaporator and the outdoor heat exchanger 50 acts as a condenser. Alternatively, when the assembly is operating in a heating mode and thus performs a heat pump cycle, the indoor heat exchanger 40 and/or hybrid head exchanger 42 act as a condenser and the outdoor heat exchanger 50 acts as an evaporator. The various heat exchangers 40, 42, 50 may each include coils through which a refrigerant may flow for heat exchange purposes, as is generally understood.

According to an example embodiment, compressor 62 may be a variable speed compressor. In this regard, compressor 62 may be operated at various speeds depending on the current air conditioning needs of the room and the demand from refrigeration loop 60. For example, according to an exemplary embodiment, compressor 62 may be configured to operate at any speed between a minimum speed, e.g., 1500 revolutions per minute (RPM), to a maximum rated speed, e.g., 3500 RPM. Notably, use of variable speed compressor 62 enables efficient operation of refrigeration loop 60 (and thus air conditioning system 10), minimizes unnecessary noise when compressor 62 does not need to operate at full speed, and ensures a comfortable environment within the room.

In exemplary embodiments as illustrated, first expansion device 64 and second expansion device 66 may be electronic expansion valves that enable controlled expansion of refrigerant, as is known in the art. More specifically, first expansion device 64 and second expansion device 66 may be configured to precisely control the expansion of the refrigerant to maintain, for example, a desired temperature differential of the refrigerant across the indoor heat exchanger 40 or between desired segments of refrigeration loop 60. As used herein, a "fully open" expansion device is intended to refer to a device that provide substantially no restriction or pressure drop to the refrigerant, i.e., a fully open expansion device acts as an open conduit. It should be appreciated, that as used herein, terms of approximation, such as "approximately," "substantially," or "about," refer to being within a ten percent margin of error.

Expansion devices 64, 66 may be operated to throttle refrigerant according to various control methodologies and to achieve various modes of operation of air conditioning system 10, as described below. For example, expansion devices 64, 66 may be controlled by controller 70 implementing a proportional-integral-derivative (PID) control algorithm or any other suitable algorithm or methodology. According to one embodiment, first expansion device 64 and second expansion device 66 throttle the flow of refrigerant based on the reaction of the temperature differential across indoor heat exchanger 40 and/or hybrid heat exchanger 42 or the amount of superheat temperature differential, thereby ensuring that the refrigerant is in the gaseous state entering compressor 62. According to alternative embodiments, first expansion device 64 and/or second expansion device 66 may be capillary tubes or another suitable expansion device configured for use in a thermodynamic cycle.

According to the illustrated exemplary embodiment, indoor fan 44 and outdoor fan 52 are illustrated as axial fans. However, it should be appreciated that according to alternative embodiments, indoor fan 44 and outdoor fan 52 may be any suitable fan type. For example, one or both of indoor fan 44 and outdoor fan 52 may be centrifugal fans. In addition, according to an exemplary embodiment, indoor fan 44 and outdoor fan 52 are variable speed fans and may rotate at different rotational speeds to generate different air flow rates. It may be desirable to operate indoor fan 44 and outdoor fan 52 at less than their maximum rated speed to ensure safe and proper operation of refrigeration loop 60 at less than its maximum rated speed, e.g., to reduce noise when full speed operation is not needed.

According to the illustrated embodiment, indoor fan 44 may be positioned upstream of indoor heat exchanger 40 along the flow direction of indoor air and outdoor fan 52 may be positioned upstream of outdoor heat exchanger 50 along the flow direction of outdoor air. Alternatively, indoor fan 44 and outdoor fan 52 may be positioned downstream of indoor heat exchanger 40 and outdoor heat exchanger 50 for urging flows of air through the indoor duct 20 and outdoor duct 30, respectively.

The operation of air conditioning system 10 including compressor 62 (and thus refrigeration loop 60 generally), indoor fan 44, outdoor fan 52, first expansion device 64, second expansion device 66, and other components of refrigeration loop 60 may be controlled by a processing device such as a controller 70. Controller 70 may be in communication (via for example a suitable wired or wireless connection) to such components of the air conditioning system 10. By way of example, the controller 70 may include a memory and one or more processing devices such as microprocessors, CPUs or the like, such as general or special purpose microprocessors operable to execute programming instructions or micro-control code associated with operation of system 10. The memory may represent random access memory such as DRAM, or read only memory such as ROM or FLASH. In one embodiment, the processor executes programming instructions stored in memory. The memory may be a separate component from the processor or may be included onboard within the processor.

System 10 may additionally include a control panel 72 and one or more user inputs, which may be included in control panel 72. The user inputs may be in communication with the controller 70. A user of the system 10 may interact with the user inputs to operate the system 10, and user commands may be transmitted between the user inputs and controller 70 to facilitate operation of the system 10 based on such user commands. A display may additionally be provided in control panel 72, and may be in communication with the controller 70. The display may, for example be a touchscreen or other text-readable display screen, or alternatively may simply be a light that can be activated and deactivated as required to provide an indication of, for example, an event or setting for the system 10.

Air conditioning system 10 may further include one or more sensors used to facilitate operation of system 10. For example, sensors may be used for measuring the temperature, pressure, humidity, or other conditions at any suitable locations within system 10 or in the ambient environment. According to the illustrated embodiment, system 10 includes a return air temperature sensor 80 and a supply air temperature sensor 82 positioned within indoor portion 12 or within the room being conditioned. The temperature sensors described herein may be any suitable temperature sensor. For example, temperature sensors 80, 82 may be a thermocouple, a thermistor, or a resistance temperature detector.

As illustrated, return air temperature sensor 80 is positioned upstream of indoor heat exchanger 40 and hybrid heat exchanger 42. More specifically, for example, return air temperature sensor 80 may be positioned proximate indoor return vent 22. In addition, supply air temperature sensor 82 is positioned downstream of indoor heat exchanger 40 and hybrid heat exchanger 42, e.g., proximate indoor supply vent 24. However, it should be appreciated that according to alternative embodiments, temperature sensors 80, 82 may be positioned at any location suitable for detecting the temperature of indoor air, such as dehumidified and reheated air to be supplied to the room.

In addition, air conditioning system 10 may include one or more humidity sensors 84. In this regard, for example, system 10 can be configured for performing a dehumidification operation when the humidity of the indoor air is above a predetermined threshold. In addition, outdoor fan 52 can be controlled in response to both a humidity measurement by humidity sensor 84 and a temperature measurement by supply air temperature sensor 80. According to the illustrated embodiment, humidity sensor 84 is positioned proximate indoor return vent 22 for measuring the humidity of return air or room air. However, humidity sensor 84 may be positioned in different locations according to alternative embodiments.

Notably, the amount of thermal energy transferred to and from air passing over the various heat exchangers 40, 42, and 50 depends at least in part on the temperature of the refrigerant passing through the respective heat exchangers. Expansion devices 64 and 66 are used to control the expansion of the refrigerant as it circulates through refrigerant loop 60 to achieve desired refrigerant temperatures at specific locations. To monitor these temperatures and enable control of expansion devices 64 and 66, refrigeration loop 60 includes multiple temperature sensors.

For example, as illustrated, refrigeration loop has a first temperature sensor 86, a second temperature sensor 88, and a third temperature sensor 90. First temperature sensor 86 is positioned on conduit 68 between outdoor heat exchanger 50 and hybrid heat exchanger 42 for measuring a first refrigerant temperature T1. Second temperature sensor 88 is positioned on conduit 68 between hybrid heat exchanger 42 and indoor heat exchanger 40 for measuring a second refrigerant temperature T2. Third temperature sensor 90 is positioned on conduit 68 between indoor heat exchanger 40 and compressor 62 for measuring a third refrigerant temperature T3. It should be appreciated that according to alternative embodiments, any suitable type, number, and position of temperature sensors may be used.

It should be appreciated that air conditioning system 10 is described herein only for the purpose of explaining aspects of the present subject matter. For example, air conditioning system 10 is used herein to describe exemplary configurations of refrigeration loop 60, the position and functions of various heat exchangers 40, 42, 50, and the types of sensors 80-90 used to facilitate control of system 10. It should be appreciated that aspects of the present subject matter may be used to operate air conditioning systems having different types of heat exchangers and various different or additional components. Thus, the exemplary components and methods described herein are used only to illustrate exemplary aspects of the present subject matter and are not intended to limit the scope of the present disclosure in any manner.

Now that the construction and configuration of air conditioning system 10 according to an exemplary embodiment of the present subject matter has been presented, an exemplary method 100 for operating an air conditioning system according to an exemplary embodiment of the present subject matter is provided. Method 100 can be used to operate air conditioning system 10, or any other suitable air conditioning system. In this regard, for example, controller 70 may be configured for implementing method 100. However, it should be appreciated that the exemplary method 100 is discussed herein only to describe exemplary aspects of the present subject matter, and is not intended to be limiting.

Figure 2:
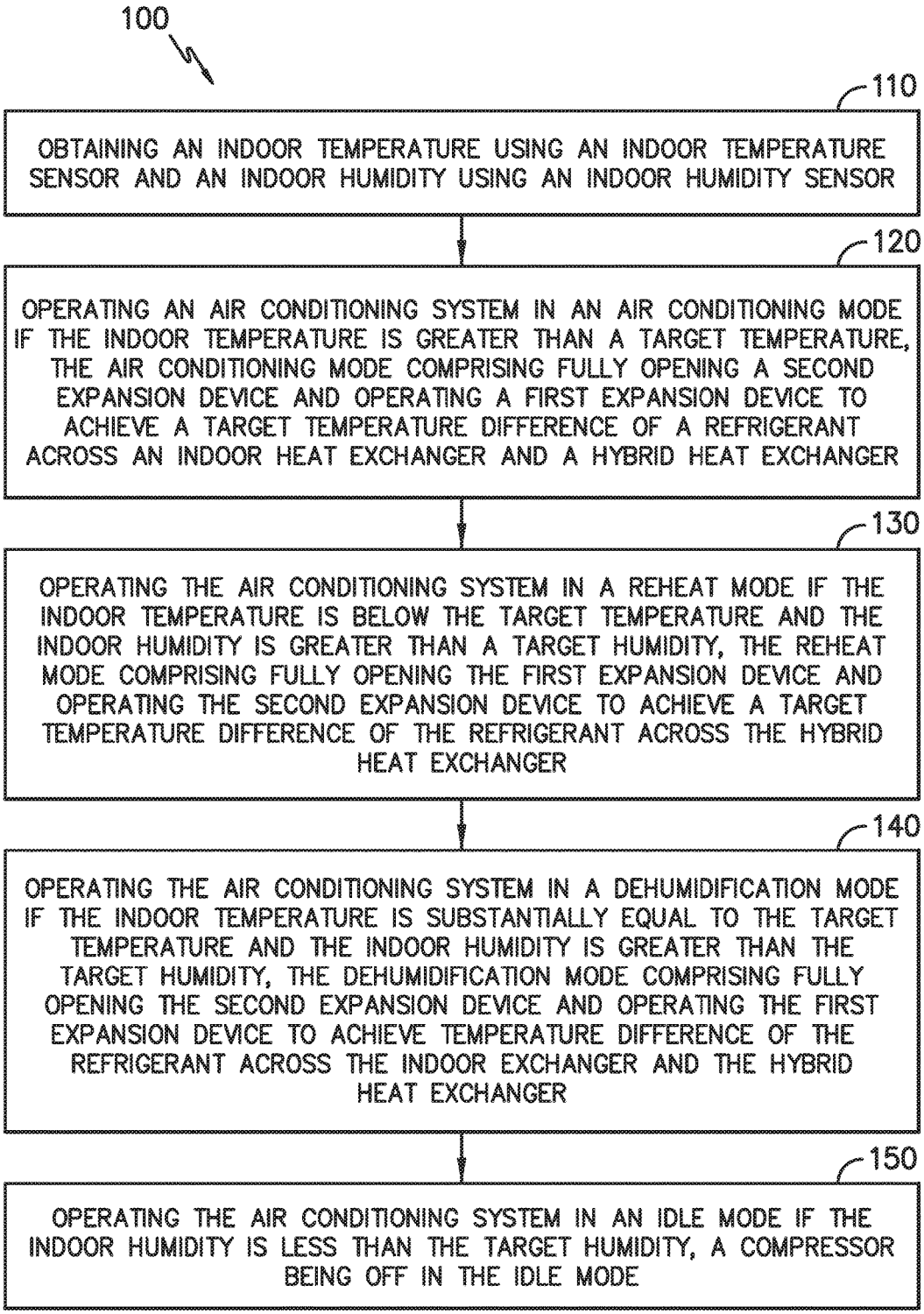
FIG. 2 is a method of operating an air conditioning system in accordance with one embodiment of the present disclosure.

Referring now to FIG. 2, method 100 includes, at step 110, obtaining an indoor temperature using an indoor temperature sensor and an indoor humidity using an indoor humidity sensor. For example, using system 10 as an example, the temperature and humidity of air supplied into the room may be measured at indoor supply vent 24 by supply air temperature sensor 82 and humidity sensor 84. Depending on the measured indoor temperature and the measured indoor humidity, controller 70 may operate air conditioning system 10 in a particular mode of operation to achieve desired objectives, such as decreasing room temperature and/or humidity, improving system efficiency, or reducing noise of operation.

For example, method 100 further includes, at step 120, operating an air conditioning system in an air conditioning mode if the indoor temperature is greater than a target temperature. As used herein, the target temperature may be set by the manufacturer or by a user, e.g., using control panel 72, or may be set in any other suitable manner. Using system 10 as an example, the air conditioning mode includes fully opening second expansion device 66 and operating first expansion device 64 to achieve a target temperature difference of a refrigerant across an indoor heat exchanger (i.e., T3–T2). According to an exemplary embodiment, the temperature difference T3–T2 is positive or may be approximately ten degrees Fahrenheit. In addition, first expansion device 64 may be operated to drive T1 (e.g., as measured by first temperature sensor 86) to approximately 55 degrees Fahrenheit, e.g., to obtain sufficient cooling of indoor air.

The air conditioning mode may further include operating compressor 62 to a minimum speed or capacity required for the indoor temperature (e.g., as measured by supply air temperature sensor 82) to the target temperature. Alternatively, the air conditioning mode may further include operating compressor 62 to a minimum speed or capacity required to adjust an evaporator pass inlet temperature T2 (e.g., as measured by second temperature sensor 88) to a heat exchanger target temperature. In addition, indoor fan 44 may be operated according to the consumer setting and outdoor fan 52 can be operated to match the compressor capacity. It should be appreciated that variations and modifications to the air conditioning mode may be made while remaining within the scope of the present subject matter. For example, controller 70 may vary the superheat differential (T3–T1), the target refrigerant temperature at the inlet of hybrid heat exchanger 42, or the speeds of fans 44, 52 or compressor 62.

Method 100 further includes, at step 130, operating the air conditioning system in a reheat mode if the indoor temperature is below the target temperature and the indoor humidity is greater than a target humidity. As used herein, the target humidity may be set by the manufacturer or the user, and is approximately 55 percent relative humidity according to one embodiment. Alternatively, the target humidity may be a dew point of 55° F., which is equivalent to 50 percent relative humidity at 72° F. Using system 10 as an example, the reheat mode includes fully opening first expansion device 64 and operating second expansion device 66 to achieve a target temperature difference of the refrigerant across the indoor exchanger (i.e., T3–T2 as measured by second temperature sensor 88 and third temperature sensor 90, respectively). According to an exemplary embodiment, the temperature difference T2–T1 is positive or may be approximately ten degrees Fahrenheit.

The reheat mode may further include operating compressor 62 to reduce an evaporator pass inlet temperature, e.g., T2 as measured by second temperature sensor 88 positioned between hybrid heat exchanger 42 and indoor heat exchanger 40. In addition, indoor fan 44 may be operated according to the consumer setting or at a low speed and outdoor fan 52 can be modulated to drive the indoor supply air (as measured by supply air temperature sensor 82) to the target temperature. It should be appreciated that variations and modifications to the reheat mode may be made while remaining within the scope of the present subject matter. For example, controller 70 may vary the refrigerant differential (T2–T1) across hybrid heat exchanger 42, the target refrigerant temperature T2 at the inlet of indoor heat exchanger 40, or the speeds of fans 44, 52 or compressor 62.

Method 100 further includes, at step 140, operating the air conditioning system in a dehumidification mode if the indoor temperature is substantially equal to the target temperature and the indoor humidity is greater than the target humidity. In this regard, if a temperature change within the room is not desirable, the dehumidification mode may be used to dehumidify indoor air without overly cooling the indoor air. Using system 10 as an example, the dehumidification mode includes fully opening second expansion device 66 and operating first expansion device 64 to achieve a target temperature difference of the refrigerant across the indoor heat exchanger (i.e., T3–T2). According to an exemplary embodiment, the temperature difference T3–T2 is positive or may be approximately ten degrees Fahrenheit.

The dehumidification mode may further include operating compressor 62 to reduce an evaporator inlet temperature, e.g., T1 as measured by first temperature sensor 86 positioned upstream of hybrid heat exchanger 42. In addition, indoor fan 44 may be operated at a low speed to match compressor 62 speed or capacity and outdoor fan 52 can be set to a consumer setting or operated at high speed. It should be appreciated that variations and modifications to the dehumidification mode may be made while remaining within the scope of the present subject matter. For example, controller 70 may vary the superheat differential (T3–T1) across hybrid heat exchanger 42 and indoor heat exchanger 40 or the speeds of fans 44, 52 or compressor 62.

Method 100 further includes, at step 150, operating the air conditioning system in an idle mode if the indoor temperature is not above the target temperature and the indoor humidity is less than the target humidity. In this regard, if the indoor air is not to hot and the indoor humidity is below the target level, e.g., 55 percent humidity, compressor 62 may be off such that refrigerant is not flowing and energy is not being expended.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioning system comprising:

a refrigeration loop comprising an outdoor heat exchanger, a hybrid heat exchanger, and an indoor heat exchanger in serial flow communication with each other;

a variable speed compressor operably coupled to the refrigeration loop and being configured for circulating refrigerant through the refrigerant loop;

a first expansion device operably coupled to the refrigeration loop between the outdoor heat exchanger and the hybrid heat exchanger;

a second expansion device operably coupled to the refrigeration loop between the hybrid heat exchanger and the indoor heat exchanger; and a controller configured for:

obtaining an indoor temperature using an indoor temperature sensor and an indoor humidity using an indoor humidity sensor;

operating the air conditioning system in an air conditioning mode if the indoor temperature is greater than a target temperature, wherein operating in the air conditioning mode comprises fully opening the second expansion device and operating the first expansion device to achieve a target temperature difference of the refrigerant between an inlet temperature of the indoor heat exchanger measured downstream of the hybrid heat exchanger and an outlet of the indoor heat exchanger; and operating the air conditioning system in a reheat mode if the indoor temperature is below the target temperature and the indoor humidity is greater than a target humidity.

2. The air conditioning system of claim 1, wherein the target temperature difference is approximately ten degrees Fahrenheit.

3. The air conditioning system of claim 1, wherein the air conditioning mode further comprises varying the speed of the compressor to adjust the inlet temperature of the indoor heat exchanger to a target temperature.

4. The air conditioning system of claim 1, wherein operating in the reheat mode comprises fully opening the first expansion device and operating the second expansion device to achieve a target temperature difference of the refrigerant across the indoor heat exchanger.

5. The air conditioning system of claim 4, wherein the target temperature difference is approximately ten degrees Fahrenheit.

6. The air conditioning system of claim 4, wherein the reheat mode further comprises operating the compressor to reduce a temperature of the refrigerant entering the indoor heat exchanger.

7. The air conditioning system of claim 1, wherein the controller is further configured for operating the air conditioning system in a dehumidification mode if the indoor temperature is substantially equal to the target temperature and the indoor humidity is greater than the target humidity, wherein operating in the dehumidification mode comprises fully opening the second expansion device and operating the first expansion device to achieve a target temperature difference of the refrigerant across both the hybrid heat exchanger and the indoor heat exchanger.

8. The air conditioning system of claim 7, wherein the target temperature difference is approximately ten degrees Fahrenheit.

9. The air conditioning system of claim 7, wherein the dehumidification mode further comprises operating the compressor to reduce an evaporator inlet temperature of the refrigerant.

10. The air conditioning system of claim 1, wherein the controller is further configured for operating the air conditioning system in an idle mode if the indoor humidity is less than the target humidity, the compressor being off in the idle mode.

11. The air conditioning system of claim 1, wherein the first expansion device and the second expansion device are electronic expansion valves.

12. The air conditioning system of claim 1, wherein the target humidity is a relative humidity of fifty-five percent.

13. The air conditioning system of claim 1, wherein the target temperature is set by a user using a control panel of the air conditioning system.

14. The air conditioning system of claim 1, further comprising:

an indoor air duct defining a return vent and a supply vent positioned downstream of the return vent, wherein the indoor heat exchanger and the hybrid heat exchanger are positioned within the indoor air duct between the return vent and the supply vent, wherein the temperature sensor is positioned downstream of the indoor heat exchanger and the hybrid heat exchanger proximate the supply vent.

15. A method of operating an air conditioning system, the air conditioning system including a refrigeration loop having a variable speed compressor for circulating a refrigerant through an outdoor heat exchanger, a first expansion device, a hybrid heat exchanger, a second expansion device, and an indoor heat exchanger, the method comprising:

obtaining an indoor temperature using an indoor temperature sensor and an indoor humidity using an indoor humidity sensor;

operating the air conditioning system in an air conditioning mode if the indoor temperature is greater than a target temperature, wherein operating in the air conditioning mode comprises fully opening the second expansion device and operating the first expansion device to achieve a target temperature difference of the refrigerant between an inlet temperature of the indoor heat exchanger measured downstream of the hybrid heat exchanger and an outlet of the indoor heat exchanger; and operating the air conditioning system in a reheat mode if the indoor temperature is below the target temperature and the indoor humidity is greater than a target humidity.

16. The method of claim 15, wherein operating in the reheat mode comprises fully opening the first expansion device and operating the second expansion device to achieve a target temperature difference of the refrigerant across the indoor heat exchanger.

17. The method of claim 15, further comprising:

operating the air conditioning system in a dehumidification mode if the indoor temperature is substantially equal to the target temperature and the indoor humidity is greater than the target humidity, wherein operating in the dehumidification mode comprises fully opening the second expansion device and operating the first expansion device to achieve a target temperature difference of the refrigerant across both the hybrid heat exchanger and the indoor heat exchanger.

18. The method of claim 15, further comprising:

operating the air conditioning system in an idle mode if the indoor humidity is less than the target humidity, the compressor being off in the idle mode.

* * * * *